United States Patent [19]

Swenson

[11] Patent Number: 4,906,896

[45] Date of Patent: Mar. 6, 1990

[54] DISK AND WASHER LINAC AND METHOD OF MANUFACTURE

[75] Inventor: Donald A. Swenson, Albuquerque, N. Mex.

[73] Assignee: Science Applications International Corporation, San Diego, Calif.

[21] Appl. No.: 252,747

[22] Filed: Oct. 3, 1988

[51] Int. Cl.[4] ..... H01J 25/10

[52] U.S. Cl. ..... 315/5.41; 315/3.6; 328/233; 376/127

[58] Field of Search ..... 315/3.5, 3.6, 5.41, 315/5.34, 5.42, 5.43, 5.46, 5.48; 328/233; 376/127; 313/360.1, 361.1, 359.1; 29/447, 593

[56] References Cited

U.S. PATENT DOCUMENTS

| | | | |
|---|---|---|---|
| 2,521,426 | 9/1950 | Trump et al. | 313/360.1 |
| 4,006,422 | 2/1977 | Schriber | 328/233 |
| 4,024,426 | 5/1977 | Vaguine | 315/5.41 |
| 4,112,373 | 10/1978 | Vaguine | 315/5.41 |
| 4,118,652 | 10/1978 | Vaguine | 315/5.41 |
| 4,146,817 | 3/1979 | McEuen et al. | 315/5.41 |
| 4,162,423 | 7/1979 | Tran | 315/5.41 |
| 4,181,894 | 1/1980 | Pottier | 328/233 |
| 4,211,954 | 7/1980 | Swenson | 315/5.41 |
| 4,269,938 | 12/1981 | Whitham | 315/5.41 |
| 4,350,921 | 9/1982 | Liska | 313/360.1 |
| 4,425,529 | 1/1984 | Leboutet | 315/5.41 |
| 4,485,346 | 11/1984 | Swenson et al. | 328/233 |
| 4,594,530 | 6/1986 | Aucouturier et al. | 315/5.41 |
| 4,596,946 | 6/1986 | Pottier | 315/5.41 |
| 4,639,641 | 1/1987 | Tronc | 315/5.41 |
| 4,651,057 | 3/1987 | Uetomi et al. | 315/5.41 |
| 4,715,038 | 12/1987 | Fraser et al. | 372/2 |
| 4,733,132 | 3/1988 | Miyata et al. | 315/3.6 X |

OTHER PUBLICATIONS

Hansborough et al., "An Optimized Design for PIGMI", IEEE Trans. on Nuclear Science, vol. NS-28, No. 2, Apr. 1981, pp. 1511-1514.

"High Energy Structures for High Gradient Proton Linac Applications", IEEE Transactions on Nuclear Science, vol. NS-24, No. 3, Jun. 1977, pp. 1087-1090.

"PIGMI: A Pion Generator for Medical Irradiations", Donald A. Swenson, LAL-81-6 Mini-Review, Feb. 1981, Los Alamos National Laboratory.

*Primary Examiner*—Eugene R. LaRoche
*Assistant Examiner*—Seung Ham
*Attorney, Agent, or Firm*—Fitch, Even, Tabin & Flannery

[57] ABSTRACT

A coupled-cavity linear accelerator for accelerating charged particles to velocities greater than about one-third the speed of light. The accelerator includes a first tank for accelerating charged particles at a first velocity to a second velocity and a second tank for accelerating the particles to a higher third velocity. A bridge coupler for focusing a beam formed by the charged particles joins the first and second tanks. Each tank is substantially symmetrical about an axis and includes a generally cylindrical tank outer wall having an inner surface and an outer surface. A series of axially spaced disks are positioned inside the tank and bear on the inside tank surface. Each disk has an outer diameter greater than the as-manufactured inside diameter of the tank wall so that each disk causes an annular indentation in the inner surface of the outer wall. At least one washer is supported by each of alternating disks. These washers have central apertures which together define a particle beam acceleration path through the tank. Methods of fabricating the linear accelerator and of tuning it are also disclosed.

20 Claims, 6 Drawing Sheets

$TM_{02}$ MODE

ACCELERATION MODE

COUPLING MODE $TM_{01}$ MODE

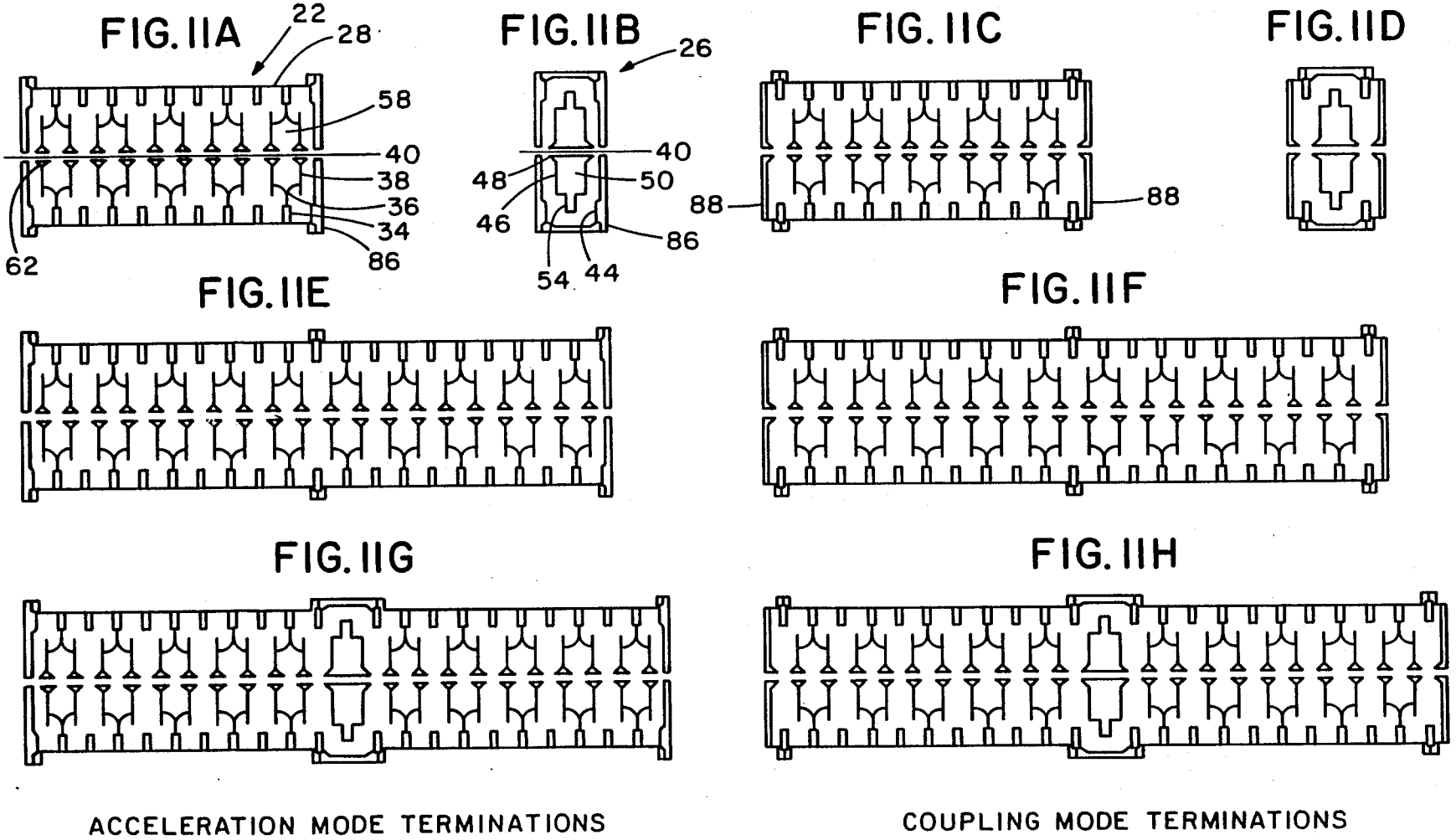
FIG. IIA
22
28
58
40
38
36
34
86
62
FIG. IIB
26
40
50
86
44
54
48
46
FIG. IIC
88
88
FIG. IID
FIG. IIE
FIG. IIF
FIG. IIG
FIG. IIH
ACCELERATION MODE TERMINATIONS
COUPLING MODE TERMINATIONS

DISK AND WASHER LINAC AND METHOD OF MANUFACTURE

BACKGROUND OF THE INVENTION

The present invention relates to an apparatus for accelerating a beam of charged particles, and more specifically to a disk-and-washer, coupled-cavity linear accelerator.

The disk and washer (DAW) linear accelerator (linac) structure, one type of coupled cavity linac, is widely recognized as one of the most efficient and stable accelerating structures for accelerating charged particles to velocities greater than half the speed of light. The DAW linac structure offers many desirable characteristics, such as superb accelerating structures for high-velocity charged particles, exceptional power efficiency, excellent field stability, and operational simplicity. One disadvantage of known DAW linac structures is that they are difficult and expensive to fabricate.

Heretofore, DAW linacs have been constructed by machining individual cells from solid billets of copper. This expensive, labor-intensive process proved quite impractical. Other manufacturing techniques have been investigated, such as hydrogen brazing. Although Los Alamos National Laboratory used hydrogen brazing to fabricate a DAW linac, brazing facilities which are currently available in private industry are unable to economically fabricate a DAW linac. For further information concerning the operation and structure of prior art linacs, reference may be made to "High Energy Accelerating Structures for High Gradient Proton Linac Applications" by Manca et al., *IEEE Transactions on Nuclear Science,* Vol. NS-24, No. 3, June 1977, pp. 1087–1090 and "PIGMI: A Pion Generator for Medical Irradiations" by Swenson, Los Alamos National Laboratory, Pub. LAL-81-6, Feb. 1981.

SUMMARY OF THE INVENTION

Among the several aspects and features of the present invention may be noted the provision of an improved DAW linac. A shrink fit procedure permits convenient construction of disk and washer assemblies outside the tank wall and electron beam and heliarc welding procedures are used to provide reliable disk/washer assemblies. The tanks and bridge couplers forming the linac have end flanges releasably holding either acceleration mode termination plates or coupling mode termination plates, facilitating reconfiguration such that the tuning process is simplified. The bridge couplers allow placement of equipment required for particle beam focusing, diagnostics...etc., adjacent to the axis of the particle beam. The tanks also include a washer support system operating to split the troublesome deflecting mode passband into two passbands straddling the operating mode. The DAW linac of the present invention is reliable in use, has long service life and is relatively easy and economical to fabricate. Other aspects and features of the present invention will be in part apparent and in part pointed out specifically in the following specification and accompanying drawings.

A coupled-cavity linear accelerator for accelerating charged particles to velocities greater than about one-third the speed of light includes a first tank for accelerating the particles to a second velocity and a second tank for accelerating the particles to a higher third velocity. The tanks are joined by a bridge coupler which operates to focus a beam formed by the charged particles. Each tank is a generally symmetrical about an axis and includes a cylindrical tank outer wall having an inside surface and an outside surface. A plurality of axially spaced disks are disposed inside the tank wall and bear on its inside surface. Each disk has an outside diameter greater than the as-manufactured inside diameter of the tank wall so that each disk causes an annular indentation in the inner surface of the outer wall. At least one washer is supported by each of alternating disks. Each washer has a central aperture and the apertures together define a particle beam acceleration path through the tank.

As a method for fabricating a tank used in a coupled-cavity linear accelerator, the present invention includes the following steps:

(a) at least one washer and one disk are assembled outside of the tank wall to form an assembly;

(b) the temperature of the assembly is reduced sufficiently so that it can be received within the outer wall without deformation;

(c) the assembly is located at a predetermined location inside the outer wall; and (d) the temperature of the assembly is permitted to rise toward that of the outer wall so that the inner surface of the outer wall is indented by the disk of the assembly to hold the assembly inside the outer wall.

BRIEF DESCRIPTION OF THE DRAWINGS

FIGS. 11A, 11B, 11C, 11D, 11E, 11F, and 11H illustrate variations in terminations of the tank sections of the accelerator to effect coupling made or accelerating mode operation.

Corresponding reference characters indicate corresponding components throughout the several views of the drawings.

DESCRIPTION OF THE PREFERRED EMBODIMENTS

Figure 1:
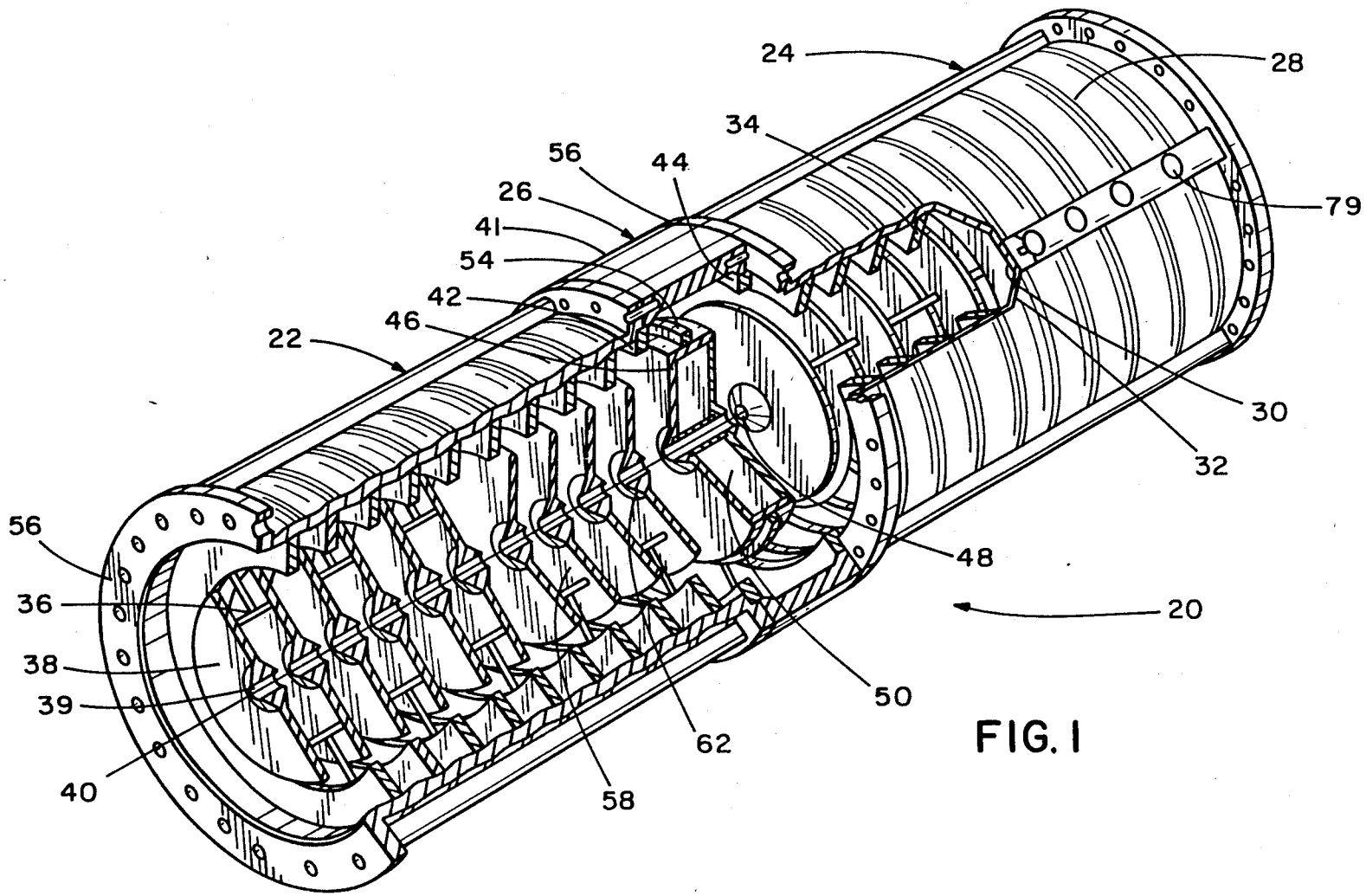
FIG. 1 is an isometric view of a portion of a disk and washer linear accelerator (linac) including two tank sections and a bridge coupler joining the tank sections, with certain components removed to expose underlying components.

Referring now to the drawings, a portion of a coupled-cavity, disk-and-washer linear accelerator embodying various aspects of the present invention for accelerating charged particles to velocities greater than about one-third the speed of light is generally indicated in FIG. 1 by reference character 20. The accelerator portion includes two spaced tank sections, 22 and 24, as well as a bridge coupler section 26 joining the tank.

Figure 3:
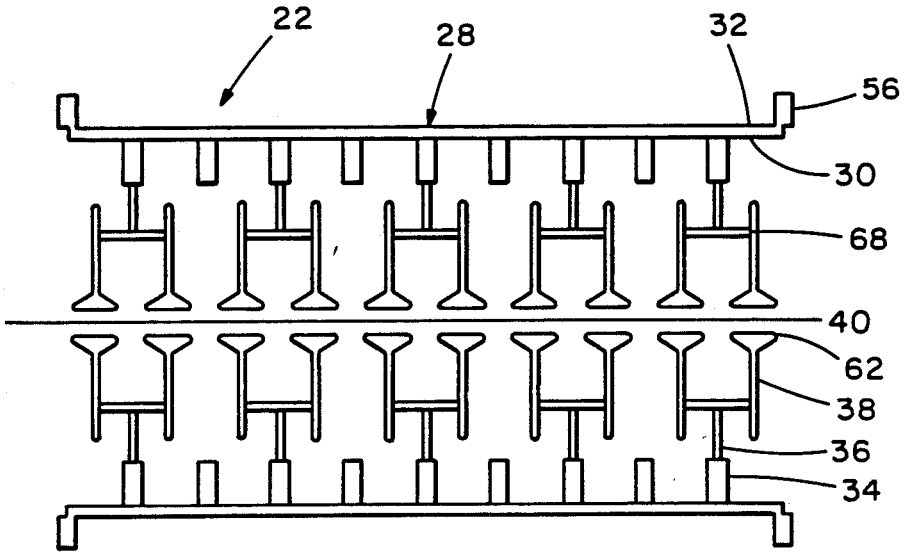
FIG. 3 is an cross-sectional view of one of the tank sections of the accelerator of FIG. 1 showing axially spaced disks, washers and support structures.

As the tank sections 22 and 24 are identical, only one of them need be described in detail. As best shown in FIGS. 1 and 3, tank section 22 has a generally cylindrical outer wall 28, with an inside surface 30, and an outside surface 32. The outer wall 28 may be fabricated from thin wall aluminum tubing (½" thickness); the inner surface 30 may be copper plated, but the as-manufactured aluminum surface is generally sufficient for non-critical applications.

Figure 9:
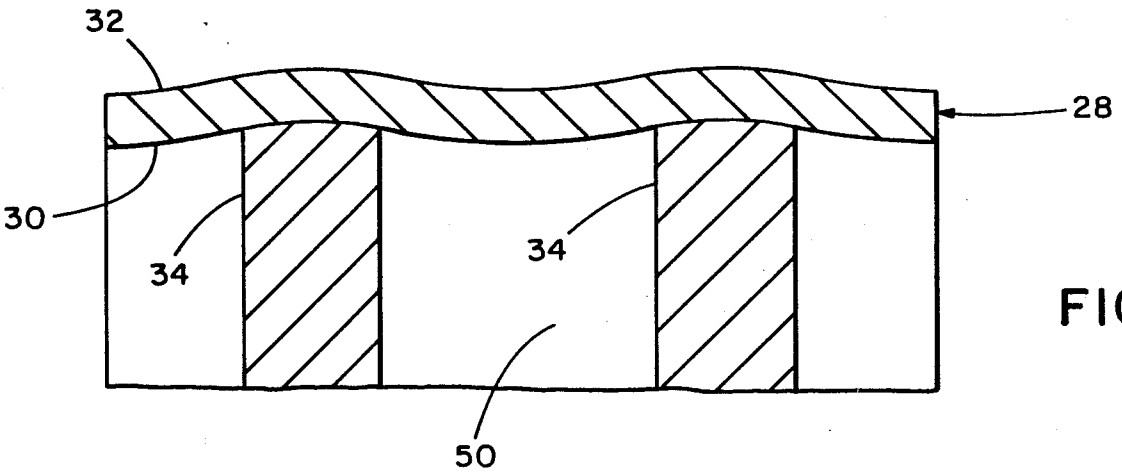
FIG. 9 depicts a portion of the tank wall showing deformations caused by expansion of disks positioned inside the tank.

The tank section 22 includes a series of axially spaced disks 34 disposed inside the tank wall 28 and bearing against the inside surface 30. Each disk 34 has an outside diameter greater than the as-manufactured inside diameter of the tank wall 28 resulting in each disk causing an annular indentation in the tank wall inner surface 30, as best shown in FIG. 9. Each of alternating ones of the disks 34 support four T-bar structures 36. The T-bar structures 36 are arranged in mutually orthogonal pairs. Each set of four T-bars supports a pair of axially spaced washers 38, best shown in FIGS. 1, 3, 5 and 6. The washers 38, preferably fabricated from oxygen-free, high-conductivity (OFHC) copper, lie in parallel planes, and each washer has a central aperture 39 which together define a charged particle beam acceleration path 40 through the tank 22.

The biperiodic nature of the washer support system serves to split the troublesome deflecting mode passband into two passbands, one on either side of the operating mode. The mutually orthogonal T-bar arrangement shunts electric field components which would otherwise result in $TM_{21}$ operation. The $TM_{21}$ mode is highly undesirable because it deflects the particle beam.

Figure 2:
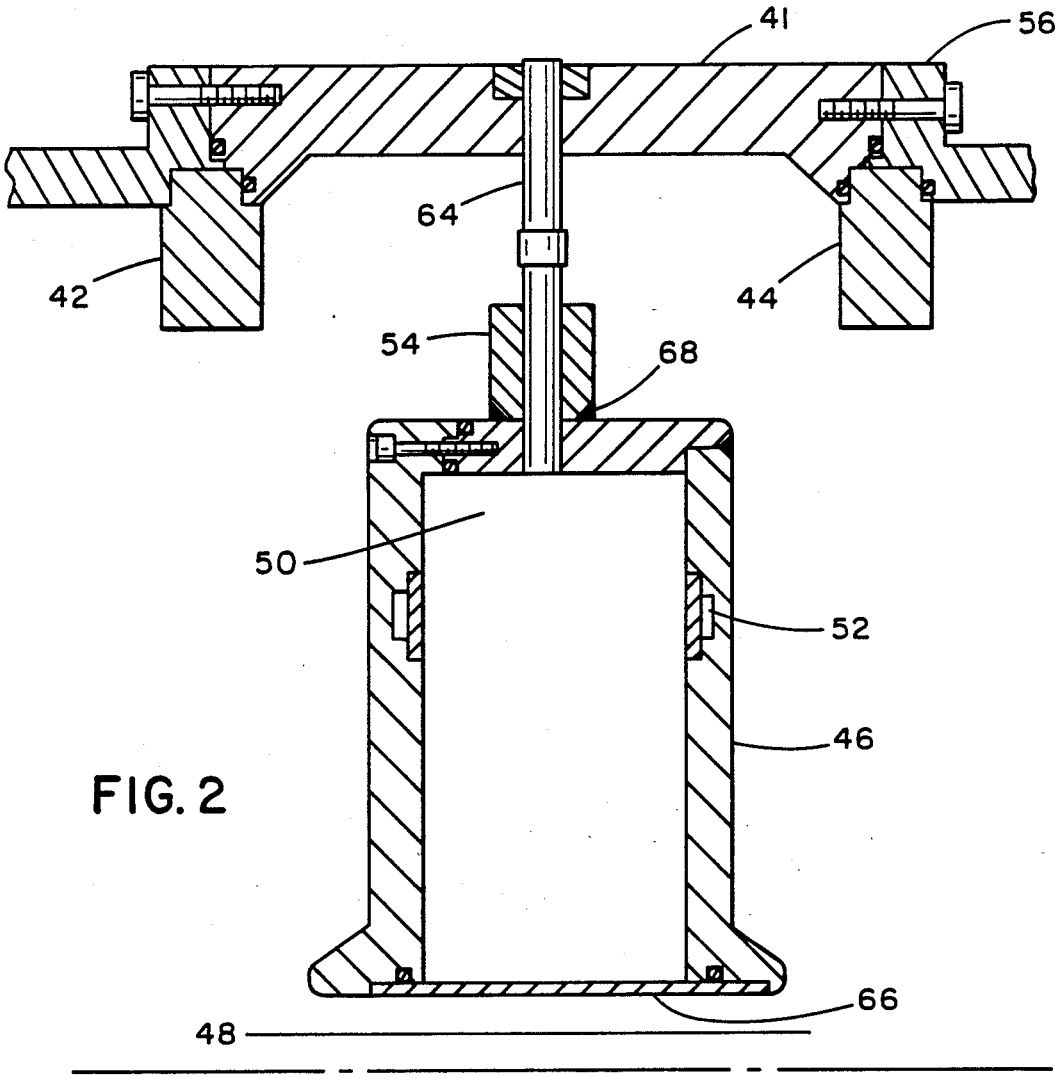
FIG. 2 is a cross-sectional view of the bridge coupler of the accelerator of FIG. 1.

Referring to FIG. 2, the bridge coupler section 26 functions to focus, shape, and diagnose the beam of charged particles between the adjacent tank sections. Bridge coupler 26 also may contain means for inducing and measuring RF energy within the accelerator structure 20; at least one vacuum port such that the accelerator structure may be evacuated; and instrumentation for measuring the air pressure within the accelerator structure 20. As with the tank sections, 22 and 24, the bridge coupler section 26 is substantially symmetrical about a central axis and includes an outer wall 41. The bridge coupler also contains a pair of disks, 42 and 44, with one disk positioned adjacent to each end of the outer wall 41. The coupler also includes an inner hub 46 having a central window 48 defining a charged particle beam acceleration path 40 through the coupler 26. The inner hub 46 includes walls defining a cavity 50 which houses various components (not shown) for focusing, shaping, and diagnosing the beam of charged particles; means for measuring and inducing RF energy within the bridge coupler 26; and means for measuring the air pressure within the accelerator 20. Channels 52 are provided for liquid-cooling the inner hub 46.

Disposed outwardly of the inner hub 46 is a rim 54. Supported by the outer wall 41 by means of four regularly spaced rim supports 64, the rim 54 has an annular geometry and is an integral part of the inner hub 46. The rim 54, has a lesser axial dimension than the inner hub 46, pushing the magnetic field lines towards the inner surface of the outer wall 41 such that RF power may be efficiently coupled into the accelerator 20.

Figure 4:
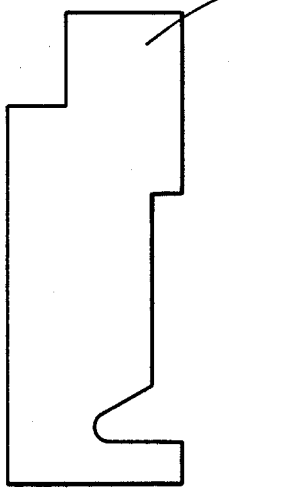
FIG. 4 shows a half-cell geometry for a tank section.
Figure 10D:
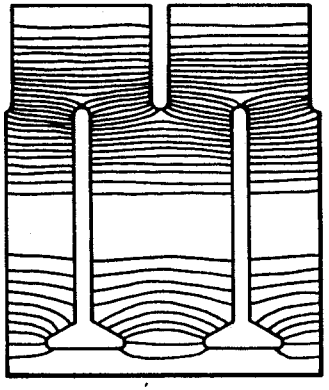
FIGS. 10A, 10B, 10C and 10D illustrate the family of RF cavity modes for the disk and washer linac structure.
Figure 10C:
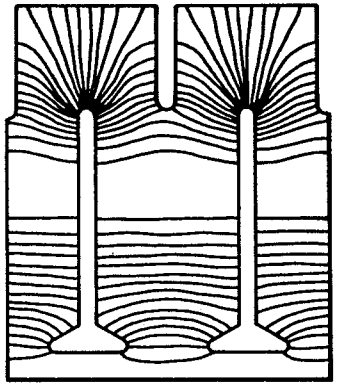
Figure 10B:
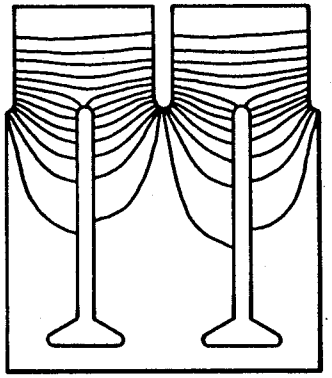
Figure 10A:
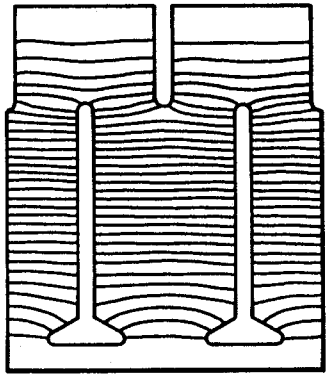

Bridge coupler 26 is of the resonantly coupled type with a large, coupling constant. Introducing the bridge coupler 26 into a chain of tank sections 22 and 24 results in a very minimal distortion of the field patterns, within the accelerator 20. FIG. 10 illustrates the electric field lines within the tank section cavities for TM01 mode (FIG. 10A), coupling mode (FIG. 10B), acceleration mode (FIG. 10C) and TM02 mode (FIG. 10D). FIG. 4 illustrates the basic shape of a typical tank section cavity.

One important feature of the invention is that the accelerator may be easily reconfigured for either acceleration mode or coupling mode operation for tuning purposes. Each tank section 22 and 24 has mounting flanges 56 disposed adjacent to each end of the outer wall 28. Referring to FIGS. 11A–11H, various configurations and combinations of tank sections and bridge couplers are shown. The linear accelerator 20 further includes acceleration mode termination end plates 86 and coupling mode termination end plates 88. These plates are easily releasably mounted on the mounting flanges 56 using simple hardware such as nuts and bolts. The end plates 86 and 88 can similarly be mounted on the bridge couplers 26. FIGS. 11A, 11B and 11G show various accelerating mode terminations while FIGS. 11C, 11D, 11F and 11H depict various coupling mode terminations. Thus, reconfiguration of the accelerator 20 for tuning purposes is simplified, as shown in FIGS. 11A–11F. Furthermore, bridge coupler sections 26 may operate in either the acceleration mode or the coupling mode.

As a method, the present invention includes the following steps:

(a) Either the acceleration mode termination end plates 86 or the coupling mode termination end plates 88 are mounted on the flanges. For example, FIG. 11A shows the acceleration mode termination end plates while FIG. 11C shows the coupling mode termination end plates.

(b) The linac is tuned for the mode of the mounted end plates.

(c) The linac is reconfigured by removing the mounted end plates from the flanges 56 and placing the end plates for the other mode on the flanges; and (d) The linac is tuned for the other mode.

Referring to FIGS. 5–8, the subassembly formed by the T-bar structures 36 and the pair of washers 38 can be assembled using an assembly fixture 74. This subassembly is then mounted on a disk 34, all prior to mounting the assembly formed by the disk 34, the pair of washers 38 and the 4 T-bars inside the tank wall 28. This greatly facilitates fabrication of a tank section because the various assemblies can be made outside the confines of the tank wall, and then loaded in series inside the tank wall. After each assembly is completed, its temperature is reduced causing the disk 34 to contract sufficiently to be received without interference inside the tank. When the assembly warms, the disk expands and indents the tank wall inside surface 30 to lock the assembly in position.

Figure 6:
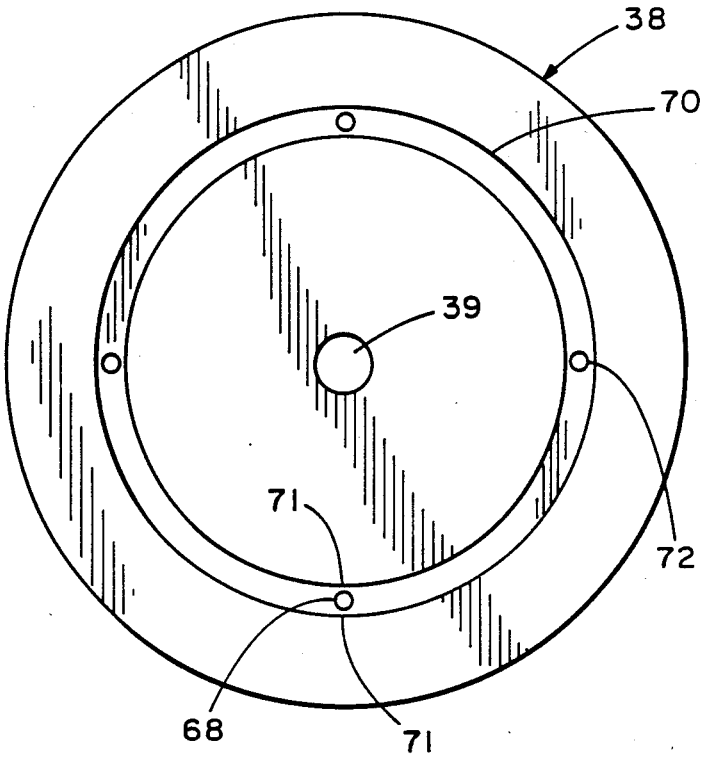
FIG. 6 is a side elevational view of the washer and support structure of FIG. 5.
Figure 8:
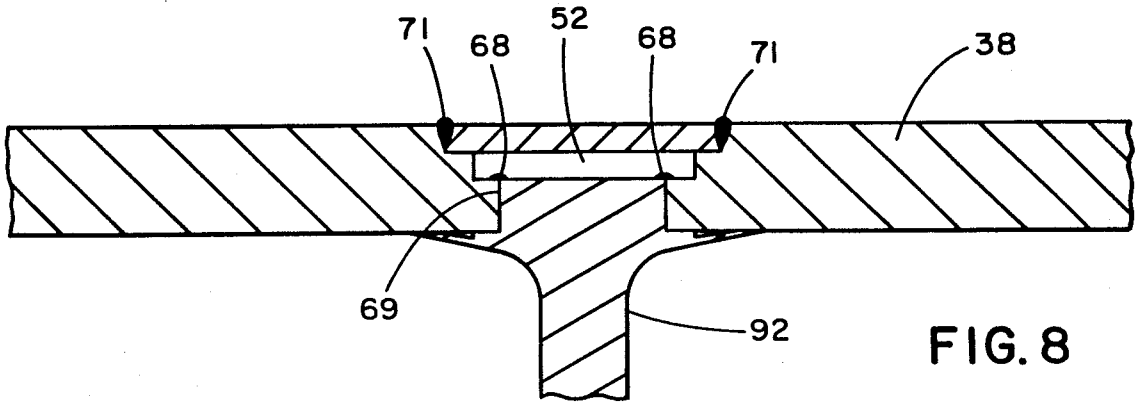
FIG. 8 shows assembly of a cooling channel cover to one of the washers in the support structure.

More specifically, each washer 38 has an enlarged interior portion 62, sometimes referred to as a "nose cone", defining the aperture 39. Each washer also has an annular slot in its outer surface for forming a cooling channel 52. Each T-bar structure 36 includes a stem 90 and a pair of arms 92 extending from the stem for holding the washers. The stem and arms define bores for supplying cool liquid to or receiving heated liquid from the channels 52. Liquid cooling of DAW linacs is known to those of skill in the art and need not be discussed further here. Each washer also has four spaced holes 69 adjoining the channel 52 for receiving the distal ends of the T-bar arms 92, as best shown in FIG. 8. The arms 92 and the washer 38 are joined using electron beam welding at locations shown by reference character 68. Such welding provides high quality, reliable joints and does not result in general heating of the components. An annular cooling channel cover plate 70 is also E-beam welded, at 71, to the washer 38 to complete the subassembly, as shown in FIGS. 6 and 8.

Figure 5:
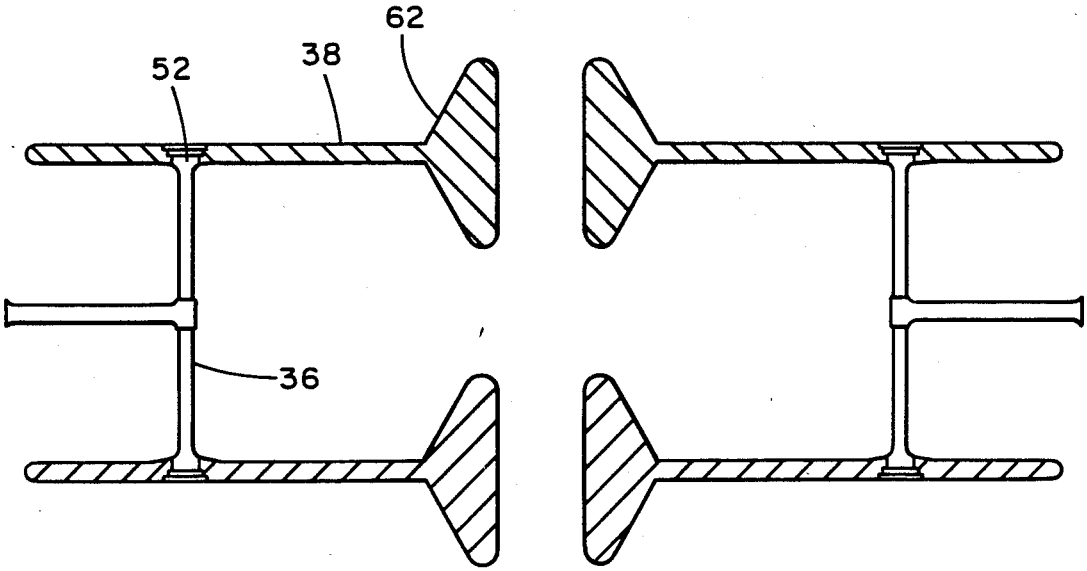
FIG. 5 shows a cross-sectional view of a washer and support structure for positioning inside the tank.
Figure 7:
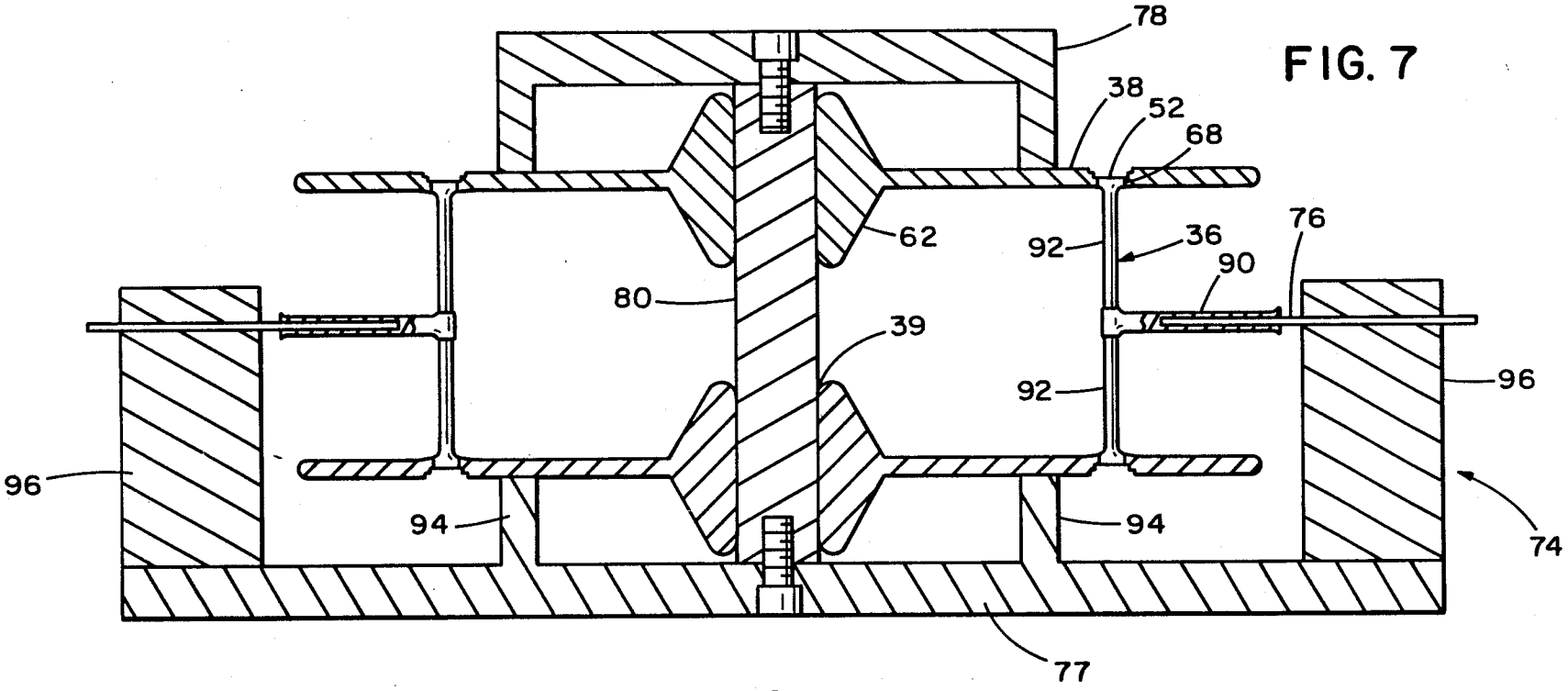
FIG. 7, similar to FIG. 5, illustrates an assembly fixture for use in forming the washer and support structure.

The assembly fixture 74 includes a strut 76 extending into the bore of each T-bar stem 90 to hold the T-bar structure 36 in position. Furthermore, the fixture includes a base 77 with upstanding arms 94 for supporting the lower washer 38, and outer arms 96 supporting the struts 76. The fixture further comprises an overlying pressure plate 78. A central alignment rod 80 extending through the washer apertures 39 and is connected to the base 77 and pressure plate 78 by bolts to permit assembly and disassembly. The completed washer and T-bar structure assembly is shown in FIG. 5. Next, the subassembly is mounted inside a disk 34 to form a disk-/washer assembly. Next, a relative temperature differential is effected between the disk/washer assembly and the tank wall 28 by immersing the completed disk-/washer assembly in dry ice to cool it to about −110 degrees Fahrenheit. The tank wall is left at room temperature. The diameter of the disk/washer assembly decreases by about 40 thousandths of an inch when the assembly reaches dry ice temperatures. The cooling operation leaves a clearance of about 30 thousandths of an inch between the assembly and the tank wall 28 so that the assembly may be maneuvered into the desired position. This desired position is readily identified because drilled through the tank wall are axially spaced sets of four radially spaced holes, as suggested by reference number 79 in FIG. 1, one of the four in the set for alignment with the bore in the stem 90 of each of the four T-bar structures 36 of each assembly. Then, the relative temperatures of the assembly and the tank wall 28 are permitted to reach equilibrium. The assembly expands, indenting the inner surface 30 of the tank wall 28. The deformation on the outer wall of the tank 28 caused by expansion of the disk/washer assembly is depicted in FIG. 9. In this manner, the assembly is held rigidly in place by the tank wall 28. A TIG (tungsten inert gas) weld is formed around each of the four holes 79 to seal the stem in position to enable the cooling fluid from a source outside the tank 22 to flow inside and out of the channels 52. Next a disk 34 without the washer subassembly is cooled and located at a predetermined position within the tank wall 28. Then another disk-/washer assembly is fabricated, cooled and located. This sequence continues until all the components are located.

As a method for fabricating a tank section 22 used in a disk and washer linear accelerator, the present invention includes several steps:

(a) Assembled outside of the tank wall 28 are at least one washer 38 on one of the disks 34 to form an assembly.

(b) A relative temperature differential is effected between this assembly and the tank so that the assembly can be received inside the tank wall 28 without interference of deformation.

(c) The assembly is located at a predetermined location inside the tank wall; and (d) The relative temperatures of the assembly and the tank wall are permitted to move toward equilibrium so that the inner surface 30 of the tank wall is indented by the disk 34 of the assembly firmly to lock the assembly inside the outer wall.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coupled-cavity linear accelerator for accelerating charged particles to velocities greater than one-third the speed of light, said accelerator comprising:

a first tank for accelerating charged particles from a first velocity to a second velocity;

a second tank for accelerating the last-mentioned particles to a third velocity greater than said second velocity; and a bridge coupler, joining said tanks, for focusing a beam of charged particles, each of said tanks being substantially symmetrical about an axis and including:

a generally cylindrical tank outer wall having an inside surface and an outside surface, a plurality of axially spaced disks disposed inside said tank wall and bearing on said tank wall inside surface, each disk having an outside diameter greater than the as-manufactured inside diameter of said tank wall so that each disk causes an annular indentation in the inner surface of said tank wall, and at least one washer supported by each of alternating ones of said disks, said washer having a central aperture and the apertures together defining a particle beam acceleration path through the tank.

2. A linear accelerator as set forth in claim 1 wherein said bridge coupler comprises:

a generally cylindrical coupler outer wall having a first end and a second end;

a pair of axially spaced coupler disks, one coupler disk positioned adjacent to each end of the coupler wall;

an inner hub having a central aperture defining a particle beam acceleration path within said bridge coupler, said hub defining a cavity adjacent to said central aperture for containing equipment such as focusing means for shaping and/or directing a beam of charged particles;

a rim integral with said inner hub, said rim disposed outwardly of said inner hub, said rim being supported by said coupler wall, said rim possessing an annular geometry, and said rim stratifying the electric fields within said bridge coupler wall such that RF power may be efficiently coupled into said bridge coupler structure, said rim having a lesser axial dimension than said hub.

3. A coupled-cavity linear accelerator as set forth in claim 2 wherein said bridge coupler is substantially symmetrical about a central axis.

4. A coupled-cavity linear accelerator as set forth in claim 1 wherein each of said alternating ones of said disks supports a pair of said washers, said washers being axially spaced.

5. A coupled-cavity linear accelerator as set forth in claim 4 further comprising support means carried by each of said alternating ones of said disks and holding an associated pair of said washers, said support means comprising a set of 4 T-bars, said T-bars being arranged in mutually orthogonal pairs.

6. A coupled-cavity, disk and washer linear accelerator as set forth in claim 1, wherein said tank sections include means permitting them to be reconfigured from one of an acceleration mode and a coupling mode to the other of said modes.

7. A coupled-cavity, disk and washer linear accelerator as set forth in claim 6, wherein said coupling mode and said acceleration mode occur at the same frequency.

8. A coupled-cavity, disk and washer linear accelerator as set forth in claim 1, wherein said bridge coupler sections include means permitting them to be reconfigured from one of an accelerating mode and a coupling mode to the other of said modes.

9. A coupled-cavity, disk and washer linear accelerator as set forth in claim 8, wherein said coupling mode and said acceleration mode occur at the same frequency.

10. A tank section for use in a coupled-cavity linear accelerator, said tank comprising:

a generally cylindrical tank outer wall having an inner surface and an outer surface; and a plurality of axially spaced disk and washer assemblies, each assembly having an as-manufactured outer diameter greater than the as-manufactured inner diameter of said tank wall, so that each said disk and washer assembly causes an annular indentation on the inner surface of said outer wall.

11. A tank section as set forth in claim 10 wherein each of said disk and washer assemblies comprises:

a disk having an outside diameter greater than the as-manufactured inside diameter of said outer wall;

a pair of axially spaced washers defining a charged particle beam acceleration path through the tank; and four T-bar structures connecting said washers to said disk, said T-bar structures being arranged in mutually orthogonal pairs so that the resulting geometry is biperiodic.

12. A tank section as set forth in claim 10 further comprising a mounting flange disposed adjacent to each end of said outer wall for releasably holding an accelerating mode termination end plate, a coupling mode termination end plate, another tank section, or a bridge coupler section, whereby reconfiguration of the accelerator for tuning purposes is simplified.

13. A bridge coupler for use in a coupled-cavity linear accelerator, said bridge coupler comprising:

a generally cylindrical coupler outer wall having a first end and a second end;

a pair of axially spaced disks with one disk disposed adjacent to each end of said coupler wall;

an inner hub having a central aperture defining a charged particle beam acceleration path within said bridge coupler, said hub having a structure defining a cavity adjacent to said central window for containing equipment such as focusing means for shaping and/or directing a beam of charged particles; and an annular rim integral with said inner hub, said rim disposed outwardly of said inner hub, said rim supported by said coupler outer wall, said rim possessing an annular structure which stratifies the electromagnetic fields within said bridge coupler walls such that RF power may be efficiently coupled into said bridge coupler structure.

14. A bridge coupler as set forth in claim 13 further comprising a mounting flange disposed adjacent to each end of said bridge coupler outer wall.

15. A method for fabricating a tank used in a coupled-cavity linear accelerator, said tank including:

a generally cylindrical outer wall;

a plurality of disks having an outside diameter greater than the inside diameter of said tank wall; and a plurality of washers for mounting on predetermined ones of said disks, said method comprising the following steps:

(a) assembling outside of said tank wall at least one washer on one of said disks to form an assembly;

(b) effecting a relative temperature differential between said assembly and said tank wall so that said assembly can be received inside said tank wall without deformation;

(c) locating said assembly at a predetermined location inside said tank wall; and (d) permitting the relative temperatures of said assembly and said tank wall to move toward equilibrium, whereby the inner surface of said tank wall is indented by the disk of said assembly to hold said assembly inside said outer wall.

16. A method for fabricating a tank as set forth in claim 15 wherein in step (a) components of said assembly are joined by means of electron beam welding.

17. A method for fabricating a tank as set forth in claim 15 wherein said step of assembly includes joining a pair of axially spaced washers to a disk by 4 T-bars, such that pairs of said T-bars are mutually orthogonal, and said pair of washers lie in parallel planes.

18. A method for fabricating a tank as set forth in claim 15 wherein the step of effecting a relative temperature differential includes reducing the temperature of said assembly.

19. A method as set forth in claim 15 comprising the further steps of:

(e) reducing the temperature of another disk so that it can be received within said wall without interference;

(f) locating the last-mentioned disk at a predetermined position within said wall; and (g) permitting the temperature of the last-mentioned disk to increase, approaching the temperature of said wall.

20. A method as set forth in claim 19 further comprising repeating steps (a), (b), (c) and (d) for forming and locating another said assembly.

* * * * *